US006012443A

United States Patent [19]

Peug

[11] Patent Number: 6,012,443

[45] Date of Patent: Jan. 11, 2000

[54] IGNITION FIXTURE FOR A GAS STOVE

[76] Inventor: Lin Tse Peug, 11F-2, No. 43, Chia-I Street, Taichung, Taiwan

[21] Appl. No.: 09/210,650

[22] Filed: Dec. 14, 1998

[51] Int. Cl.[7] ..... F24C 3/00; F23Q 7/06; A47G 29/02

[52] U.S. Cl. ..... 126/39 E; 126/41 R; 431/263; 431/264; 431/262; 431/258; 248/229.15; 248/230.1; 248/230.7; 248/226.11

[58] Field of Search ..... 126/39 E, 41 R; 431/263, 264, 343, 266, 262, 265, 191, 258, 260; 248/229.15, 226.11, 298.1, 230.1, 230.4, 230.7

[56] References Cited

U.S. PATENT DOCUMENTS

| | | | |
|---|---|---|---|
| 3,490,857 | 1/1970 | Good | 431/264 |
| 3,814,077 | 6/1974 | Riehl | 126/39 E |
| 3,823,345 | 7/1974 | Mitts et al. | 431/263 |
| 4,177,034 | 12/1979 | Jones | 431/264 |
| 4,302,181 | 11/1981 | Schlosser | 431/264 |
| 4,337,029 | 6/1982 | McElroy et al. | 431/264 |
| 4,791,734 | 12/1988 | Wojtkowiak | 431/264 |
| 4,861,264 | 8/1989 | Romanak et al. | 431/264 |
| 4,941,817 | 7/1990 | Schlosser | 431/264 |
| 4,943,232 | 7/1990 | Lin | 431/264 |
| 5,407,161 | 4/1995 | Mulkeran | 248/231.8 |
| 5,669,728 | 9/1997 | Koba | 248/230.1 |
| 5,741,129 | 4/1998 | Li | 431/264 |
| 5,836,756 | 11/1998 | Moss | 431/263 |

*Primary Examiner*—Ira S. Lazarus
*Assistant Examiner*—David Lee
*Attorney, Agent, or Firm*—Charles E. Baxley, Esq.

[57] ABSTRACT

An ignition fixture includes a body has a hole and two slits defined through the top thereof so that the ignition device is received in the hole and a plate is connected to the body by inserting two insertions into the two slits. The plate has two bosses extending from the upper surface thereof which is inserted into a passage of an adjustable member which has two rows of positioning holes to receive the two bosses. The adjustable member has two slots so as to be connected to the bottom of the stove by extending bolts through the slots and engaged with the stove. The distance between the stove and the ignition device can be adjusted by receiving the bosses into the suitable pair of positioning holes.

4 Claims, 4 Drawing Sheets

IGNITION FIXTURE FOR A GAS STOVE

FIELD OF THE INVENTION

The present invention relates to an ignition fixture for a gas stove, and more particularly, to an adjustable ignition fixture which can be connected to the stoves having different sizes.

BACKGROUND OF THE INVENTION

A conventional ignition fixture is shown in FIG. 1 and is a plate 7 which is connected to the bottom of the gas stove (not shown) at the first end thereof by bolts 70 extending through the holes 73 defined through the plate 7 and engaged with the gas stove. A hole 71 is defined in the second end of the plate 7, a stop 72 is formed by pressing from the material of the plate 7 and extends below the plate 7 so that the ignition means 8 can be received in the hole 71 and supported on the stop 72. The ignition means 8 is further positioned by a C-shaped clamp 75. The distance between the ignition means 8 and the stove is limited so as to have the best ignition result so that the length of the plate 7 of the conventional fixture has a fixed size. However, the gas stoves sold in the market have several sizes so that the manufacturers have to prepare several fixtures with different sizes so that the users may choose the correct one to be connected to the stove. The others of the fixtures are then discarded.

The present invention intends to provide an ignition fixture wherein the distance between the ignition means and the stove can be adjusted according to the types of the stoves.

The present invention has arisen to mitigate and/or obviate the disadvantage of the conventional ignition fixture.

SUMMARY OF THE INVENTION

In accordance with one aspect of the present invention, there is provided an ignition fixture comprising a body having a hole defined in the top thereof so as to receive the ignition means therein and a plate extending from the body and having two bosses extending from the upper surface thereof. An adjustable member has a first end with two slots defined therethrough so as to be connected to the bottom of the stove by bolts extending through the slots and engaged with the stove, and a second end having a top and a bottom thereof between which a passage is defined. The top has two rows of positioning defined therethrough so as to receive the two bosses when the plate is inserted into the passage.

The object of the present invention is to provide the ignition fixture wherein the distance between the stove and the ignition means can be easily adjusted.

Another object of the present invention is to provide the ignition fixture which is suitable to the stoves with different sizes.

Further features of the present invention will become apparent after a careful reading of the detailed description with appropriate reference to the accompanying drawings.

DETAILED DESCRIPTION OF THE PREFERRED EMBODIMENTS

Figure 1:
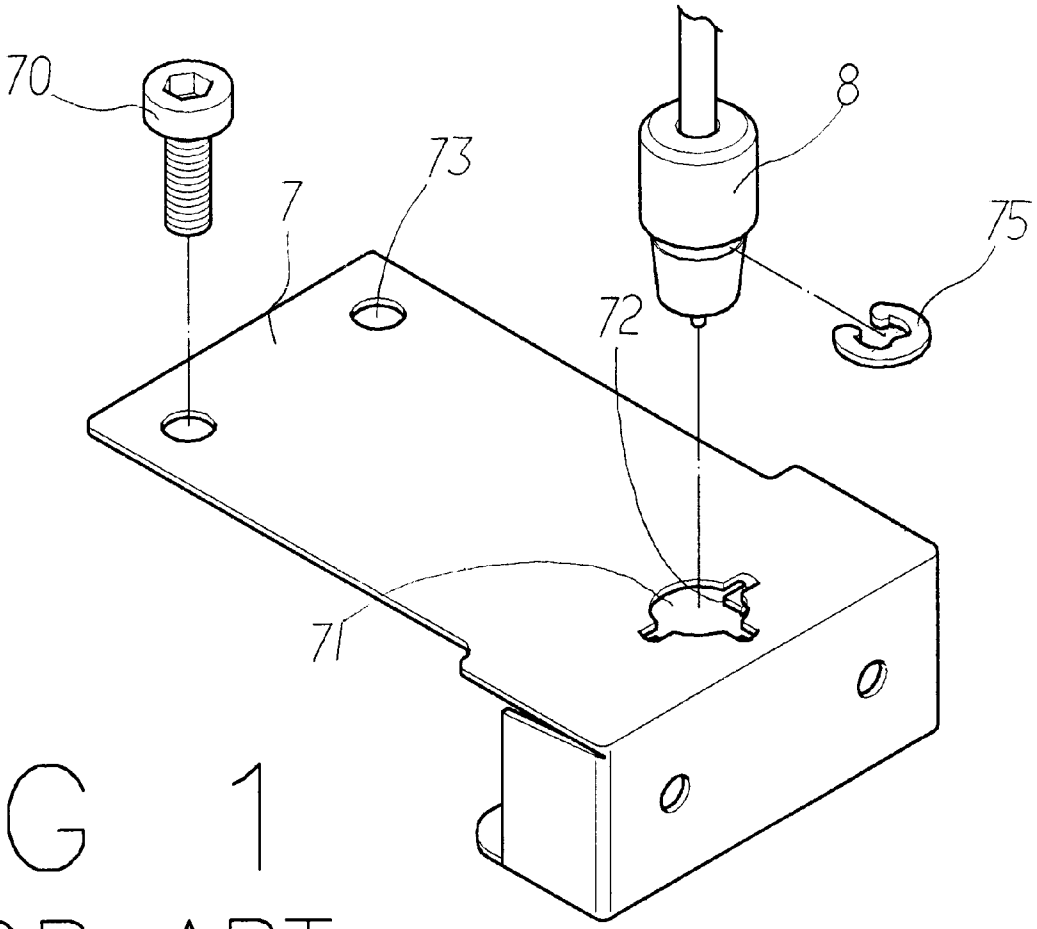
FIG 1 PRIOR ART
FIG. 1 is an exploded view of the conventional ignition means and the ignition fixture.
Figure 2:
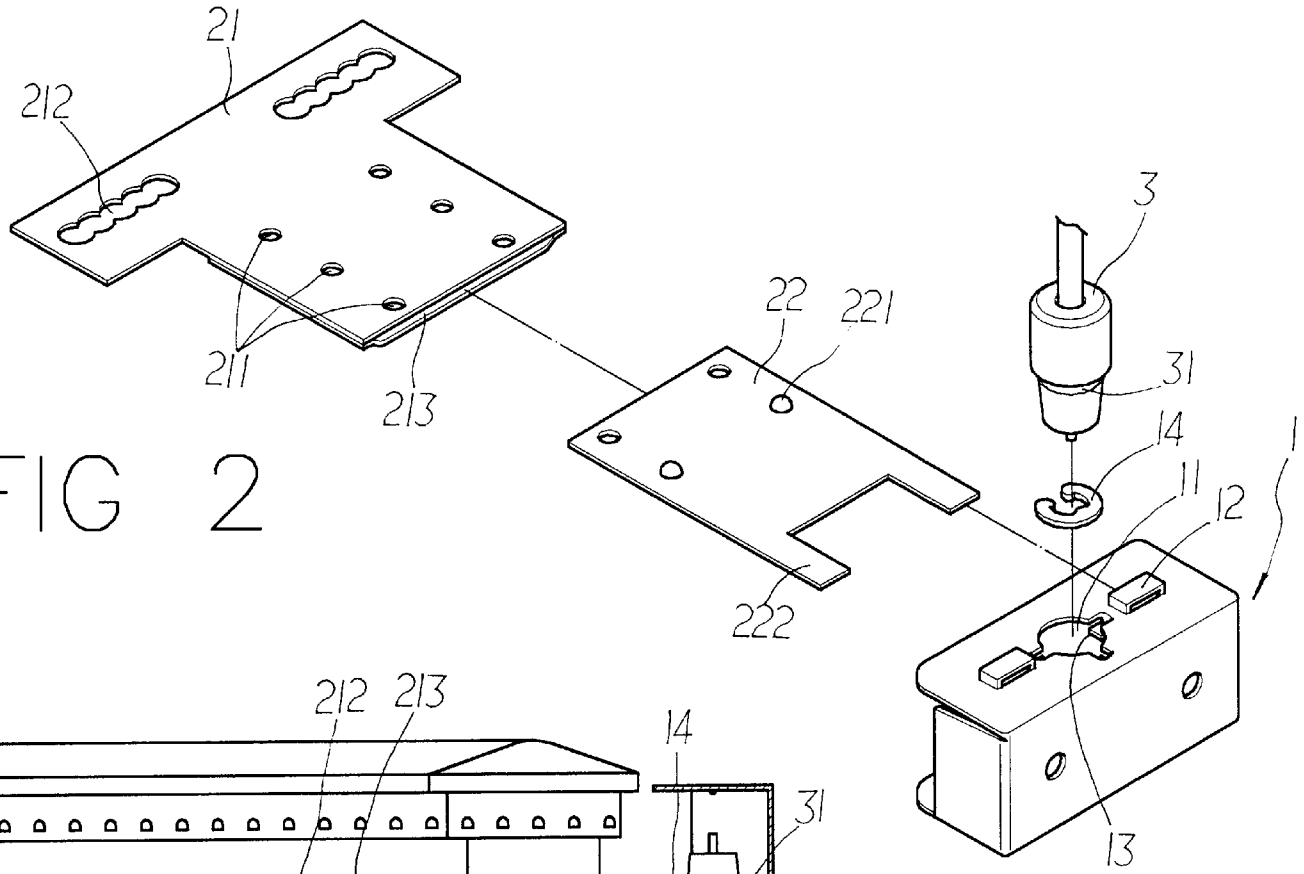
FIG. 2 is an exploded view of the ignition means and the ignition fixture in accordance with the present invention.
Figure 3:
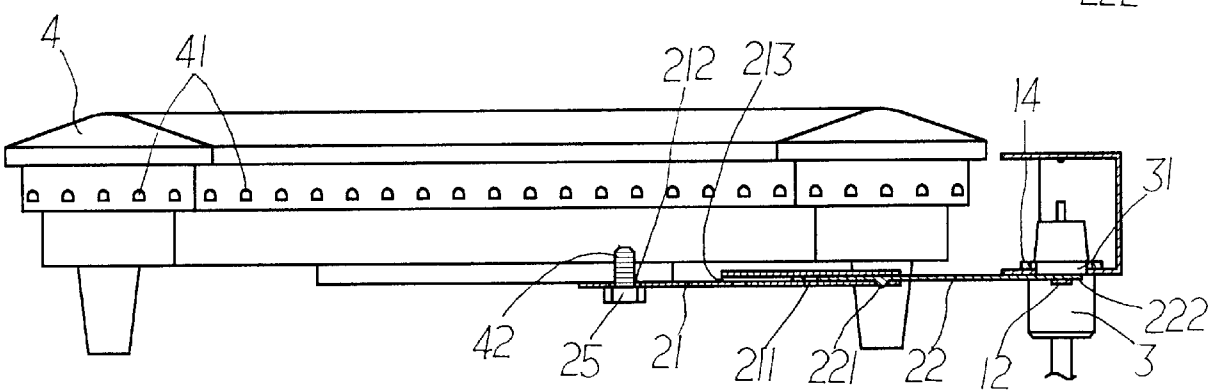
FIG. 3 is a side elevational view, partly in section, of the combination of the ignition means connected to the ignition fixture in accordance with the present invention and the stove.
Figure 4:
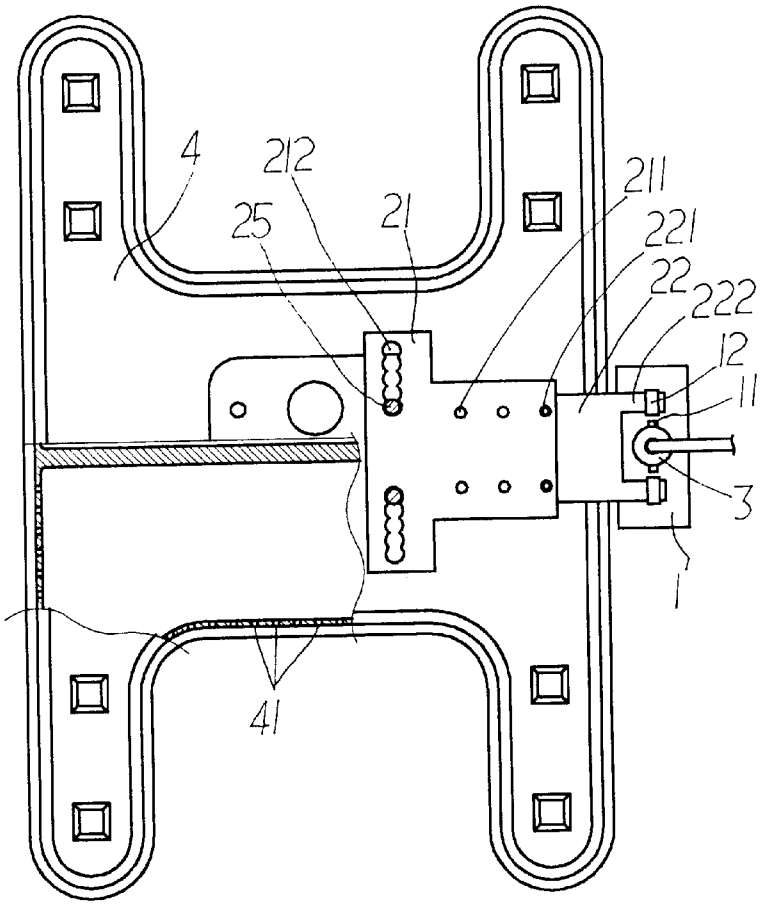
FIG. 4 is a bottom view to show that the ignition fixture in accordance with the present invention is connected to the bottom of the stove having the first size.

Referring to FIGS. 2 to 4, the ignition fixture in accordance with the present invention comprises a body 1 which is a box-like member and has a hole 11 defined in the top thereof, a stop 13 is formed by pressing the material of the top downwardly from the periphery defining the hole 11 so that the ignition means 3 is received in the hole 11 and its shoulder portion 31 is supported by the stop 13 and a C-shaped clamp 14 is further clamp the ignition means 3 in position. Two slits 12 are defined in the top of the body 1 and the hole 11 is therefore located between the two slits 12.

A plate 22 has two insertions 222 extending therefrom so as to be received in the two slits 12 of the body 1 and two bosses 221 extend from the upper surface of the plate 22.

An adjustable member 21 has a first end with two slots 212 defined therethrough and a second end having a top and a bottom thereof so as to define a passage 213 between the top and the bottom. Each of the two slots 212 of the adjustable member 21 has a serrated inner periphery so as to define a plurality of positions for the bolts 25 extending therethrough and threadedly engaged to the bottom of the stove 4 having a plurality of gas outlets 41 as shown in FIG. 3. The top of the adjustable member 21 has two rows of positioning holes 211 defined therethrough so as to receive the two bosses 221 when the plate 22 is inserted into the passage 213.

Figure 5:
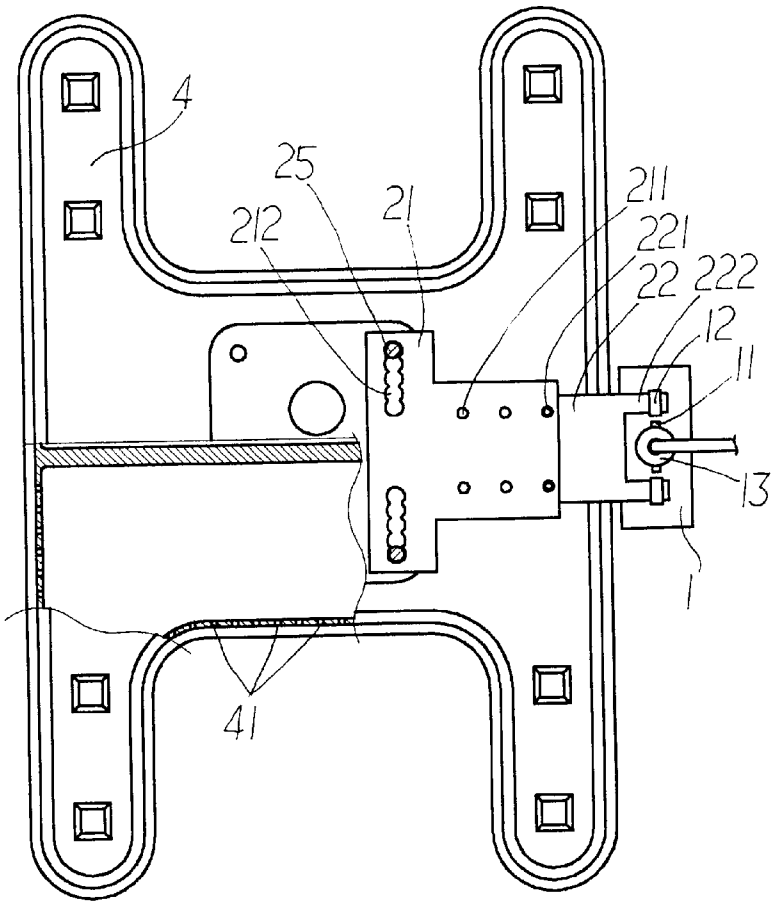
FIG. 5 is a bottom view to show that the ignition fixture in accordance with the present invention is connected to the bottom of the stove having the second size.

Therefore, the distance between the ignition means 3 and the stove 4 is adjusted by receiving the bosses 221 into different pairs of positioning holes 211 of the adjustable member 21. Referring to FIG. 5, the bolts 25 are allowed to extending through the slots 212 at different positions when compared with the positions shown in FIG. 4 so that the adjustable member 21 can be also connected to the stove having different size relative to the stove as shown in FIG. 4 without any amendment.

Figure 6:
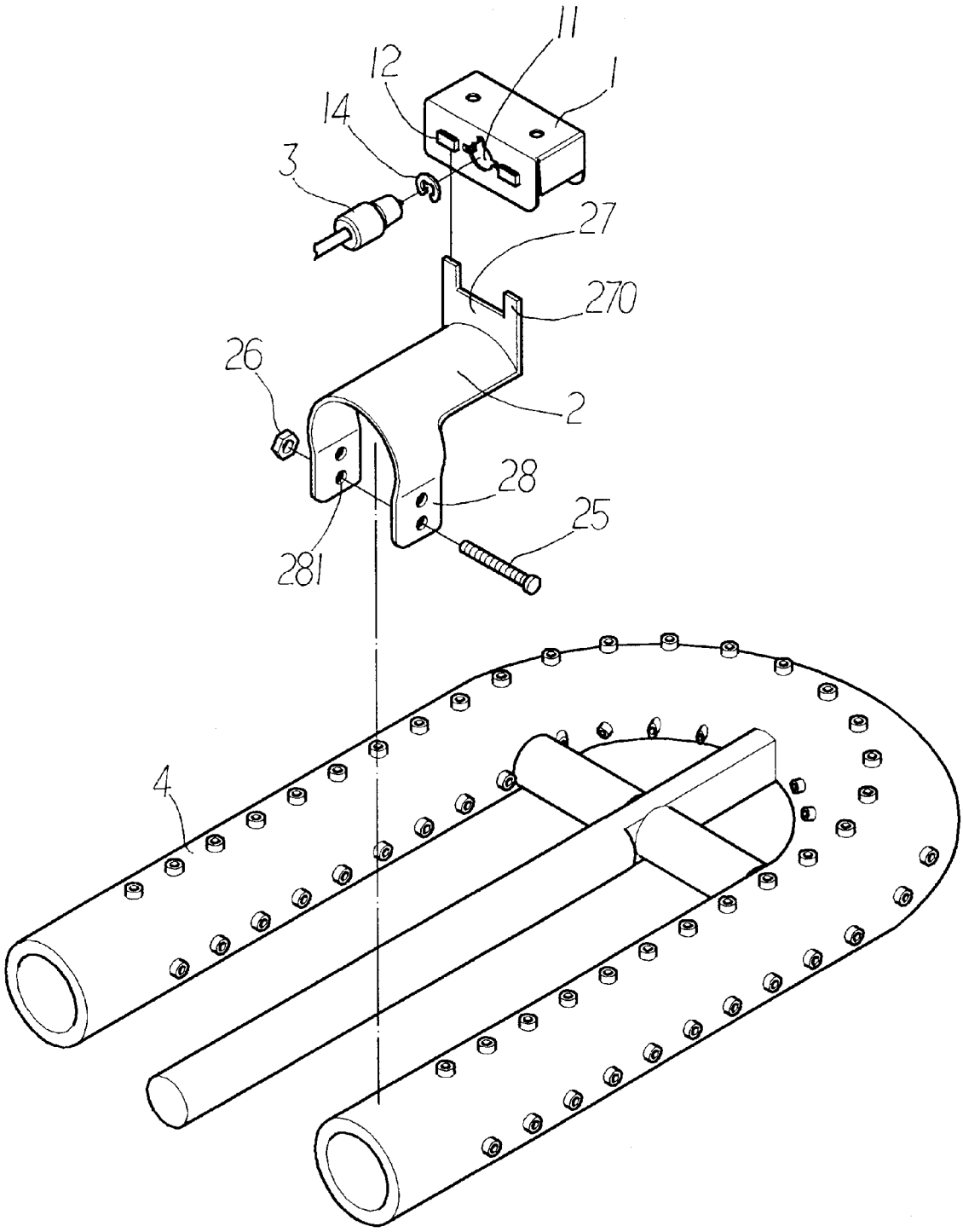
FIG. 6 is an exploded view of the ignition means, the other embodiment of the ignition fixture in accordance with the present invention and another type of gas stove.

FIG. 6 shows another embodiment of the ignition fixture which comprises a body 1 having a hole 11 defined in one of the two sides thereof so as to receive the ignition means 3 in the hole 11, wherein the ignition means 3 s further positioned by using a C-shaped clamp 14. Two slits 12 are defined in the side of the body 1 and let the hole 11 be located between the two slits 12. A U-shaped member 2 has a connecting portion 27 extending from the first end thereof wherein the connecting portion 27 has two insertions 270 extending therefrom so as to be received in the two slits 12. Two lugs 28 extend from the second end of the U-shaped member 2 and each of the two lugs 28 has at least two pairs of holes 281 so as to securely mount on the gas tube 4 by extending a bolt 25 through the holes 281 in the two lugs 28 and engaged with a nut 26.

It is to be understood that the above description and drawings are only used for illustrating some embodiments of the present invention, not intended to limit the scope thereof. Any variation and derivation from the above description and drawings should be included in the scope of the present invention.

What is claimed is:

1. An ignition fixture for a gas stove having an ignition means, comprising:

a body having a hole defined in the top thereof so as to be adapted to receive the ignition means in said hole;

a plate extending from said body and having at least two bosses extending from the upper surface thereof;

an adjustable member having a first end with two slots defined therethrough and a second end having a top and a bottom thereof so as to define a passage between said top and said bottom of said adjustable member, said top having two rows of positioning holes defined therethrough so as to receive said at least two bosses when said plate is inserted into said passage, and a plurality of bolts extending through said slots such that adjustable member is adapted to be connected to the bottom of the stove.

2. The ignition fixture as claimed in claim 1 further comprising two slits defined in the top of said body and said plate having two insertions extending therefrom so as to be received in said two slits.

3. The ignition fixture as claimed in claim 1, wherein each of said two slots of said adjustable member has a serrated inner periphery.

4. An ignition fixture for a gas stove having an ignition means and a gas tube, comprising:

a body having two sides and a hole defined in one of said two sides thereof so as to be adapted to receive the ignition means in said hole, two slits defined in said side of said body and said hole located between said two slits, and a U-shaped member having a connecting portion extending from a first end of said U-shaped member, said connecting portion having two insertions extending therefrom, said two insertions received in said two slits, two lugs extending from a second end of said U-shaped member, a bolt extending through said two lugs and adapted to receive the gas tube between said two lugs.

* * * * *